US005181409A

United States Patent [19]

Heyes et al.

[11] Patent Number: 5,181,409

[45] Date of Patent: Jan. 26, 1993

[54] METHOD OF MANUFACTURING A WALL IRONED CAN

[75] Inventors: Peter J. Heyes, Wantage; Ian M. Leishman, Didcot; Kevin J. Pope, Wantage, all of United Kingdom

[73] Assignee: CMB Foodcan plc, Worcester, United Kingdom

[21] Appl. No.: 734,172

[22] Filed: Jul. 22, 1991

[30] Foreign Application Priority Data

Jul. 28, 1990 [GB] United Kingdom ..... 9016602

[51] Int. Cl.[5] ..... B21B 45/00

[52] U.S. Cl. ..... 72/46; 72/41; 72/347; 156/224

[58] Field of Search ..... 72/46, 347, 41; 156/224, 223, 221, 220; 427/388.1; 428/35.8, 35.9

[56] References Cited

U.S. PATENT DOCUMENTS

| | | | |
|---|---|---|---|
| 3,206,848 | 9/1965 | Rentmeester . | |
| 3,293,895 | 12/1966 | Kohan et al. | 72/46 |
| 3,340,714 | 9/1967 | Pohl et al. | 156/224 |
| 3,762,598 | 10/1973 | Gayner et al. . | |
| 3,832,962 | 9/1974 | Rolles | 72/46 |
| 3,933,559 | 1/1976 | Watanabe | 156/224 |
| 4,096,815 | 6/1978 | Faulkner | 72/46 |
| 4,361,020 | 11/1982 | Hirota et al. | 72/347 |
| 4,366,662 | 1/1983 | Katsura et al. . | |
| 4,935,079 | 6/1990 | Nelson-Ashley et al. | 156/224 |
| 4,984,708 | 1/1991 | Imazu et al. | 220/660 |
| 5,072,605 | 12/1991 | Imazu et al. | 72/347 |

FOREIGN PATENT DOCUMENTS

| | | | |
|---|---|---|---|
| 0062385 | 10/1982 | European Pat. Off. . | |
| 0312304 | 4/1989 | European Pat. Off. . | |
| 0404420 | 12/1990 | European Pat. Off. . | |
| 58-25591 | 5/1983 | Japan . | |
| 1044225 | 2/1989 | Japan | 72/46 |
| 1278921 | 11/1989 | Japan | 72/46 |
| 2003415 | 3/1979 | United Kingdom . | |
| 8103293 | 11/1981 | World Int. Prop. O. | 72/46 |

*Primary Examiner*—Lowell A. Larson
*Assistant Examiner*—Michael J. McKeon
*Attorney, Agent, or Firm*—Burns, Doane, Swecker & Mathis

[57] ABSTRACT

In a method of drawing and wall ironing a can body, a blank (1) is cut from a laminate of aluminium or alloy and a polyester film. The blank is lubricated and drawn to a cup (7) having a side wall (8), which is then wall ironed. A terminal margin (14) of the side wall (13) of the wall ironed can is heated to a temperature above 100° C. but below the crystalline melting point of the polyester film in order to prevent delamination of the polyester film from the side wall of the can during subsequent washing of the can. A benefit of the process is that the heating of the side wall margin (14) does not soften the aluminium or aluminium alloy body.

14 Claims, 3 Drawing Sheets

Fig.1(a)
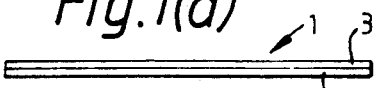
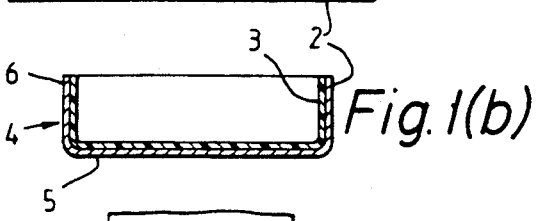
Fig.1(b)
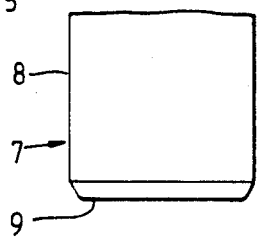
Fig.1(c)
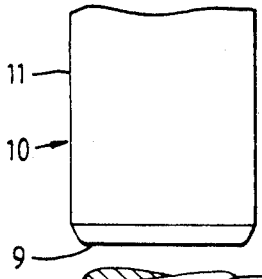
Fig.1(d)
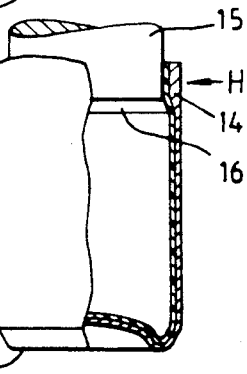
Fig.1(e)
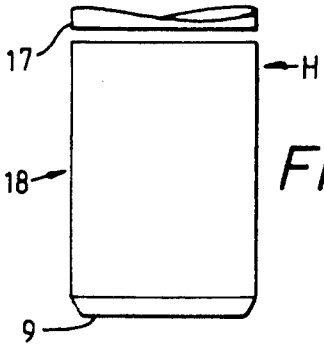
Fig.1(f)
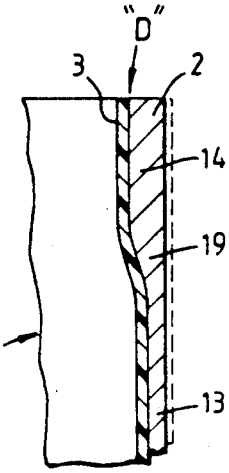
Fig.2
Fig.3
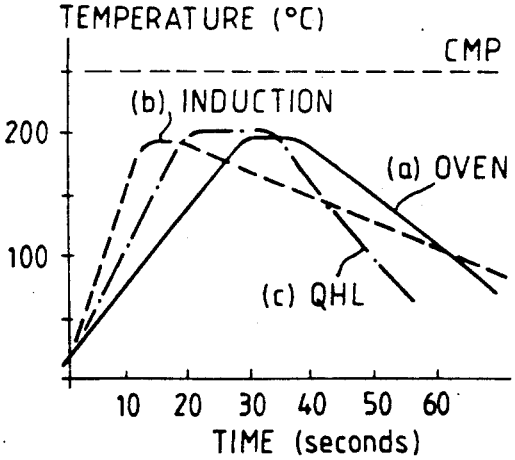

METHOD OF MANUFACTURING A WALL IRONED CAN

BACKGROUND OF THE INVENTION

This invention relates to a method of manufacturing a can by deep drawing a blank cut from a laminate of sheet metal and a polyester film and thereafter wall ironing the cup to a can body. This invention also provides a can made by the method.

Our copending European patent application published number 0312304 describes laminates of linear polyester film and sheet metal such as electrochrome coated steel or aluminium alloy. These laminates are used to manufacture can bodies by a process which includes the steps of cutting a blank from the laminate, applying a lubricant; drawing the blank to a cup; passing the cup through at least one wall ironing die to reduce the side wall thickness and increase its length; trimming the wall ironed side walls to desired height; washing the wall ironed can body to remove lubricant; and drying the can to receive printed decoration.

The laminates, and method described, permit conversion of a circular blank, 140 mm in diameter of laminate (such as aluminium alloy 3004 of thickness 0.315 mm/polyethylene terephthalate 0.015 mm thick) to a wall ironed can 65 mm diameter by 115 mm tall having a side wall thickness of 0.125 mm and a thicker rim margin at the mouth which is 0.188 mm thick.

However, during manufacture of these laminates the metal M (as denoted in FIG. 10) is heated to a temperature $T_1$ insufficient to melt the entire thickness of polyester film, polymer film A,B is then fed from rolls $R_1$, $R_2$ to be applied at pinch rolls $P_1$, $P_2$ is the preheated metal. The initial laminate so made is then reheated to a temperature $T_2$ by an induction heater $H_2$ before passing through a quenching apparatus which immerses the initial laminate in cold water which travels on the surface of the laminate through ambient air to be collected in a tank $T_a$ from which the quenched laminate is removed. In the process described in EP 0312304 the metal laminate was reheated to a temperature $T_2$ of about 320° C. This relatively high temperature improves the bond of polyester to aluminium but is expensive to obtain and liable to weaken the aluminium alloy.

We have observed that if the laminating temperature is reduced below 300° C. to retain strength of alloy there is an increased risk of delamination of the polymer film from the side wall of the can body while the can body passes through a conventional spray washing apparatus.

This problem of delamination is also aggravated by more severe wall ironing reductions such as reduction of an alloy 3004 blank 140 mm×0.30 mm thick to a side wall 0.105 mm leaving a rim margin thickness of 0.167 mm.

We have also observed that there is a marked increase in delamination if the alloy 3004 blank lacks a pretreatment such as is produced by anodising in, for example, phosphoric acid or conversion to a chromium phosphate.

We have discovered that delamination of the polymer film initiated in the can washing operation can be suppressed by heat treatment before the thermal cycles of drying after washing, and stoving after decorating, which will further improve the bond of film to metal giving an acceptable can.

Summarizing the consequences of delamination:

1. it limits the reduction in wall thickness of the can;
2. it forces one to use lamination temperatures that can reduce the strength of the aluminium alloy so forcing one to use more metal;
3. it adds to the cost by requiring chemical surface treatments to the metal such as alloy 3004.

BRIEF DESCRIPTION OF THE PRIOR ART

Japanese Patent Application Laid Open No. 58-25591 describes a process in which laminates of metal and thermoplastic polyester having a crystallinity in the range of 0 to 30%, are drawn to cups which are heat treated by wet or dry heat to increase the crystallinity of the polymer film into a range between 5% to 50%. Whilst examples are given to show improvement of the polyester/ferrous metal substrate, example 7 describes manufacture of an aluminium plate coated at 210° C. using a polyester composed of, as dicarboxylic acid component, 65% terephthalic acid and 35 mol % isophthalic acid and as diolcomponent 60 mol % 1,4 butane diol and 40 mol % polytetramethylene glycol. The degree of crystallisation of the resin layer was 7%. Containers 100 mm tall by 50 mm diameter were drawn and formed from this laminate and the containers were treated in hot water at 100° C. for one hour so that the crystallinity increased to 28%. According to table 1 cans of example 7 that were not heat treated, exhibited "strong leafing at impact and blistering in "corner part and cup upper part, inspite of lamination at 240° C. for 30 seconds. These examples demonstrate the problem of inadequate bonding that we seek to overcome.

European Patent Application Published No. 0404420, filed before but published after the priority date of this application, describes in Example 4 the drawing and redrawing of a lubricated blank cut from a laminate of Al/Mg type aluminium alloy sheet 0.24 mm thick and a polyethylene terephthalate film 20 microns thick on both sides. The blanks were preheated before drawing. These drawn cans were washed and heat treated for 1 minute at 220° C. Then, according to customary procedures the can was degreased, washed and subjected to trimming, printing (baking at 205° C. for 2 minutes) necking and flanging to form a barrel for a two-piece can.

In table 1 we are told that the side wall of these cans were not wall ironed and that no change arose in heat resistance (assessed by a peel test); formability (assessed by necking a flanging); or corrosion resistance (assessed by pack test). On page 6 line 38 it is said that "the obtained deep drawn can is subjected to heat treatment directly or after a post treatment such as water washing or drying"; this option indicates that the applicant had not encountered our problem of delamination in a can washing apparatus.

SUMMARY OF THE INVENTION

Accordingly this invention provides a method of forming a can body from a laminate of sheet metal and a polymeric film by:

(a) applying a lubricant to both surfaces of the laminate and cutting a blank from the laminate;
(b) drawing the blank to a cup having a bottom wall and a side wall upstanding from the periphery of the bottom wall;
(c) reducing the thickness of the side wall by pushing the cup through a wall ironing die, and
(d) washing the can body, characterised in that, in step (a) the laminate is a laminate of sheet aluminium or aluminium alloy and a film of an amorphous linear polyester or copolyester;

and after step (c) but before step (d) a terminal margin of the side wall of the wall ironed cup is heated to a temperature above 100° C. but below the crystalline melting point of the film.

The polyester film may be applied to one major surface of the aluminium substrate so that preferably the polyester film is on the inside of the wall ironed can. However, if desired, polyester film may be applied to both sides of the aluminium substrate, in which case both inside and outside surfaces of the wall ironed can will be covered by polyester film.

The polyester film will generally be the product of reaction between a dibasic alcohol and a dibasic acid. For example the polyester may be a product of reaction between terephthalic acid and ethylene glycol e.g. polyethylene terephthalate. If desired the polyester may include a third component acid or alcohol present as less than 50% of said acid or alcohol eg ethylene glycol, terephthalic acid and isophthalic acid; or ethylene glycol-diethylene glycol and terephthalic acid.

Preferably the aluminium or aluminium alloy, such as alloy 3004 or 3104, has an anodised surface, produced by treatment in sulphuric or phosphoric acid, such as an oxide thickness of 20 to 100 nanometers or a chromate-phosphate.

The side wall margin may be locally heated by hot air directed on to it; or by radiation from radiant bars or lamps to a temperature above 150° C. but below the crystalline melting point of the polyester for a period of less than 20 seconds. Alternatively the side wall margin is heated to a temperature above 150° C. but below the crystalline melting point of the polyester by induction heating for a period between 50 and 100 milliseconds.

This invention also provides a can made by the method.

BRIEF DESCRIPTION OF THE DRAWINGS

Various embodiments will now be described by way of example and with reference to the accompanying drawings in which:

FIG. 1*a* is a side view of a disc shaped blank cut from a laminate;

FIG. 1*b* is a sectioned side view of a cup drawn from the blank of FIG. 1*a;*

FIG. 1*c* is a side view of a redrawn cup formed from the cup of FIG. 1*b;*

FIG. 1*d* is a side view of a wall ironed cup formed from the cup of FIG. 1*c;*

FIG. 1*e* is a part-sectioned side view of a wall ironed can body formed from a cup of FIG. 1*d* to have a thick rim;

FIG. 1*f* is a side view of the can body of FIG. 1*e* after trimming of the thick rim;

FIG. 2 is an enlarged fragmentary section of the thick rim of the trimmed can body of FIG. 1*f;*

FIG. 3 is a graph of can rim temperature v time;

DESCRIPTION OF PREFERRED EMBODIMENTS

Figure 4:
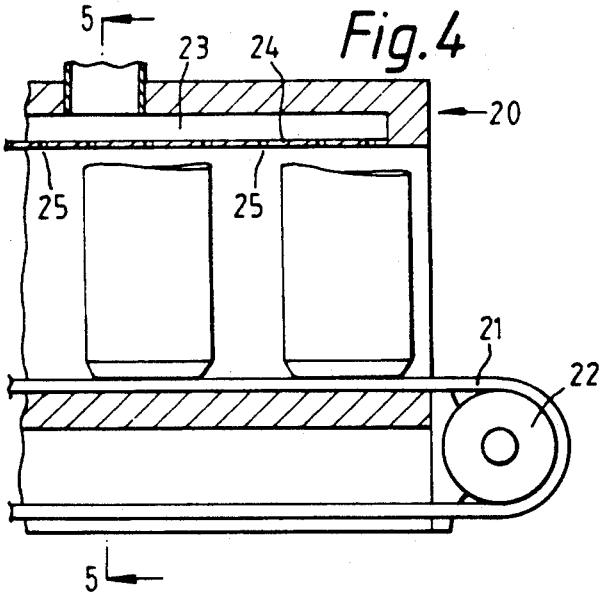
FIG. 4 is a diagrammatic sectioned side view of an entry part of a downdraught oven.

FIGS. 1*a* to 1*f* show a sequence of components made to form a can body from a laminate of sheet metal and a polymeric film by a sequence of (a) blanking, (b) drawing, (c) redrawing, (d) wall ironing, and (e) trimming operations.

According to this invention a circular blank 1 shown in FIG. 1*a* comprises a substrate of aluminium or aluminium alloy sheet and a film 3 of an amorphous linear polyester or copolyester which is bonded to one major surface of the sheet metal. Prior to drawing in a press tool this blank is lubricated with an aqueous emulsion of a lubricant/coolant such as "Drawsol 919" sold by Stuart Ironside Co.

FIG. 1*b* shows a shallow cup drawn from the laminate of FIG. 1*a* so that the cup comprises a bottom wall 5 and a cylindrical side wall 6 upstanding from the periphery of the bottom wall. The polyester film 3 covers the interior surfaces of the bottom wall 5 and side wall 6 of the cup 4.

FIG. 1*c* shows a redrawn cup formed from the cup of FIG. 1*b* by means of a punch die and blank holder (not shown) to have an increased side wall height 8 and a reduced overall diameter of side wall and bottom 9.

FIG. 1*d* shows a wall ironed cup 10 formed from the redrawn cup 7 of FIG. 1*c* by means of the same redraw punch and a wall ironing ring (not shown). The clearance between the interior of the ring and exterior of the punch was less than the thickness of the side wall 8 of the redrawn cup so that passage of the redrawn cup through the ironing die reduces the side wall thickness and increases the height of the ironed side wall 11 but does not alter the bottom 9.

FIG. 1*e* shows a wall ironed cup 12 after passage of the cup of FIG. 1*d* through a second ironing ring which further reduces the thickness of most of the side wall to create a longer side wall 13. However it will be noticed that a rim margin 14 of the side wall is maintained at greater thickness by using a punch 15 having an annular relief 16 to accommodate the side wall margin without thinning.

FIG. 1*f* shows that the wall ironed cup 12 of FIG. 1*e* is trimmed within the relatively thick rim margin 14 to remove an annulus 17 of eared material and define a mouth of the can body 18 at the desired body height.

The can body 18 is then passed into an apparatus having spray nozzles to direct washing fluid onto the can body in order to remove lubricants applied to the blank 1, cup 7 or wall ironed cup 10 during the forming processes.

We have observed that certain laminates give rise to delamination of the polyester 3 from the metal substrate 2 of the wall ironed cans at the position "D" shown in FIG. 2. FIG. 2 shows, on an enlarged scale, part of the wall ironed side wall 13 and a transition portion 19 of increasing thickness extending from the side wall to the relatively thick rim portion 14. Delamination of the polyester film and metal substrate is believed to be an edge effect induced by washing.

We have discovered that this risk of delamination in the washing apparatus may be prevented by heating a terminal margin 14 of the wall ironed side wall to a temperature greater than 100° C. but below the crystalline melting point of the polyester film. FIG. 3 shows two examples of useful heat treatment cycles. After heating for an appropriate period of time the polyester film 3 is again firmly bonded to the metal 2 and the can may safely be passed into the washing apparatus.

In FIG. 1*e* the heat denoted by arrow H is applied to the thicker wall portion 14 of the wall ironed side wall 13, preferably to an annular margin about 20 mm wide.

Alternatively, FIG. 1*f* shows, by arrow $H_1$, that the heat may be applied to a side wall margin, about 15 mm wide, of the trimmed can body 18. This is probably the preferred manner of carrying out the invention because the application of heat to the trimmed can body will rectify any disturbance of the polyester film caused by the rotary trimming tools.

Figure 5:
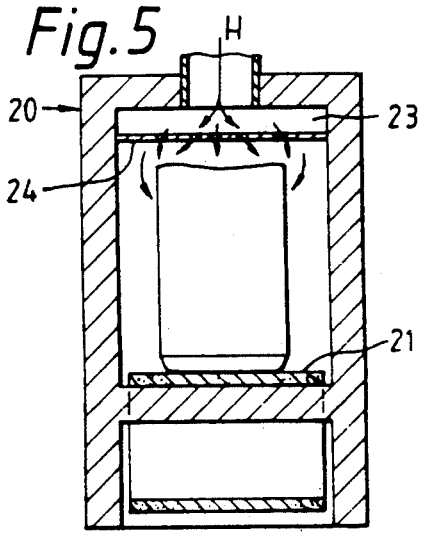
FIG. 5 is a diagrammatic elevation of the downdraught oven sectioned on line A—A' in FIG. 4.

FIGS. 4 and 5 show diagrammatically one end of a long oven 20 of substantially rectangular cross-section through which extends a continuous mesh conveyor belt 21 which is driven to pass through the oven by driven rolls, one of which is denoted 22. The oven 20 has a roof void 23 into which hot air is fed as arrowed H. The hot air is distributed from the roof void by a baffle plate 24 having an array of apertures 25 to direct the hot air onto the rim margin 14 of can conveyed, mouth upwards, by the conveyor belt through the oven. Control of the temperature of hot air and the speed of travel of the conveyor 21 permit the establishment of the heat treatment cycle shown as graph (a) in FIG. 3. It will be noticed that the increase in temperature occurs in about 30 seconds followed by a dwell at a chosen temperature at say 200° C. for about 5 seconds, after which the temperature abates. Such a treatment is useful for cans made of a laminate comprising aluminium alloy 3004 and a polyethylene terephthalate film.

Figure 6:
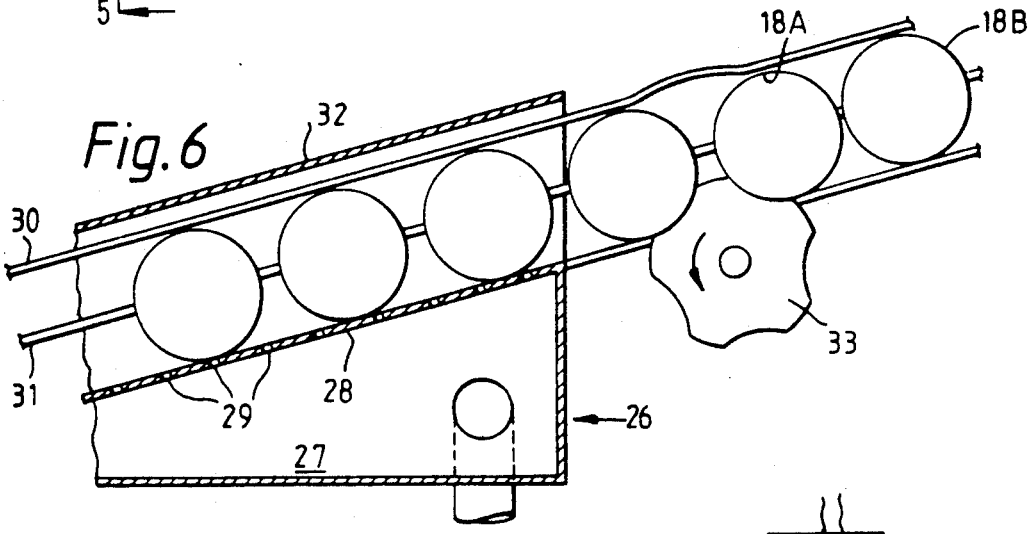
FIG. 6 is a diagrammatic sectioned side view of an updraught oven having an inclined guide surface for cans.

FIG. 6 shows an alternative form of oven 26 in which hot air is distributed upwardly from a plenum chamber 27 having a sloping roof 28 which includes a row of slots 29 to direct hot air onto the rim margin of can bodies rolling down the sloping roof of the plenum chamber. The cans 18 are guided during their rolling motion by guide rails 30, 31 and enclosed in a tunnel housing 32. It is desirable that each can body rolls at a distance from the next adjacent can bodies in order that hot air can circulate around the side wall margins. This is achieved by means of a driven scalloped roll 33 which separates each leading can body 18A from the row of approaching bodies 18B and urges it individually into the oven tunnel 32. Again the heating cycle as achieved is shown in FIG. 3, graph (a).

Figure 7:
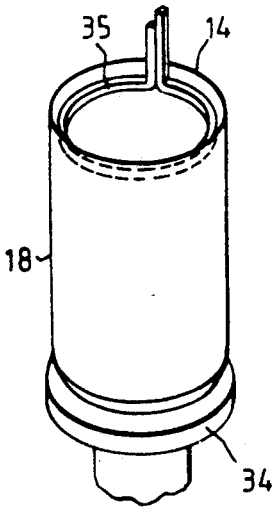
FIG. 7 is a sketch of a can body and internal induction heating coil.
Figure 8:
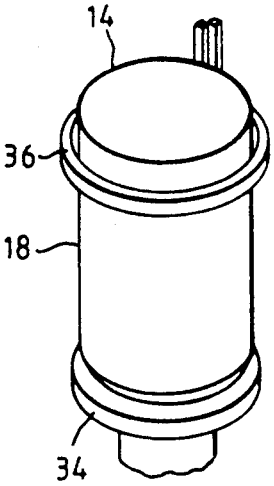
FIG. 8 is a sketch of a can body and an external induction heating coil.

FIGS. 7 and 8 show a can body 18 supported on a lifter pad 34 at a level such that the side wall margin is substantially level with an induction coil. In FIG. 7 the coil 35 is surrounded by the side wall margin 14. In FIG. 8 the coil 36 surrounds the side wall margin 14. In both cases, passage of current through the induction coil causes rapid heating of the aluminium metal of the side wall to achieve rapid heating as shown in FIG. 3*b*. After rapid heating to a temperature between 100° C. and the crystalline melting point of the polyester, the temperature is maintained for a period of time between 50 and 100 milliseconds and then allowed to cool as the heat in the metal dissipates.

Figure 9:
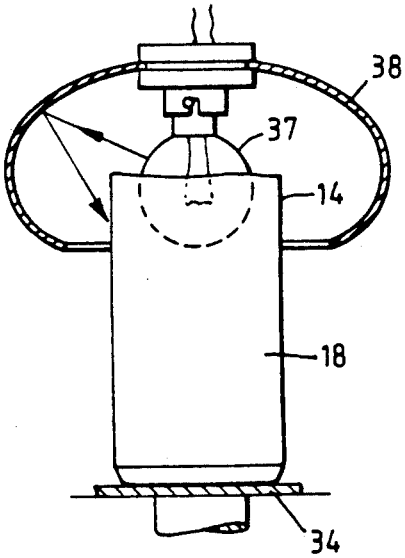
FIG. 9 is a sketched end view of a tunnel having radiant heating elements in the roof.

FIG. 9 shows an alternative heating apparatus which comprises a quartz halogen bulb 37 supported inside a reflector housing 38 and a support pad which holds the rim margin of a can body at a level to surround the bulb. Light/heat emitted from the top of the bulb is reflected by the elliptical reflector surface to strike the outside of the rim margin 14: heat/light shining directly from the bulb heats the inside surface of the can body. The heating graph is expected to exhibit a heating rate between those arising from induction heat and oven heating, see graph (QHL) in FIG. 3.

The benefits arising from heating of the rim margin of wall ironed cans were tested by making wall ironed cans from laminates of aluminium alloy 3004 having a commercially available phosphate surface treatment, and a 12 micron thick coextruded film of polyethylene terephthalate (PET)/copolyester, the copolyester serving to bond the PET to the metal. Table 1 shows clearly that laminates (example 1) prepared at a lamination temperature of 320° C. did not delaminate when the wall ironed cans were washed but laminated prepared at a lesser lamination temperature showed increased tendency to delaminate during washing. Examples 2 to 6 as shown in Table 1 demonstrate the effect of lamination temperature on tendency to delaminate in a washing apparatus.

Table 2 shows in like manner to Table 1 that can bodies subjected to the rim heating treatment according to this invention did not show any tendency to delaminate in the washing apparatus. Even the laminates using the as rolled surface (devoid of surface treatment) survived washing without delamination, as is shown by examples 7 to 10.

Therefore the benefits available from heating of the rim of wall ironed cans made from aluminium/polyester laminates are:

(a) the cost of metal surface treatments may be avoided;
(b) the cost of higher laminating temperatures may be reduced;
(c) useful can bodies may be made at less cost of metal by virtue of thinner side walls.

Whilst the invention has been described in terms of a laminate of sheet metal having polyester film on one side only it will be understood that polyester or other film may also be applied to the other side of the sheet metal. Preferably the polyester film is located inside the wall ironed can for the purpose of creating a can for beverages. However circumstances may require a polyester film on the outside of the can body.

TABLE 1

Polymer Coated DWI Cans - Delamination after Forming

| Example Number | Aluminium Alloy 3004 Gauge (mm) | Aluminium Alloy 3004 Surface | Lamination Temperature (T2) | Thinwall Gauge (mm) | Thickwall Gauge (mm) | Delamination |
|---|---|---|---|---|---|---|
| 1 | 0.315 | C/P | 320° C. | 0.125 | 0.188 | 0 |
| 2 | 0.315 | C/P | 290° C. | 0.125 | 0.188 | 3 |
| 3 | 0.30 | C/P | 320° C. | 0.117 | 0.183 | 1 |
| 4 | 0.30 | C/P | 320° C. | 0.105 | 0.167 | 2 |

TABLE 1-continued

| Polymer Coated DWI Cans - Delamination after Forming | | | | | | |
|---|---|---|---|---|---|---|
| | Aluminium Alloy | | | | | |
| Example Number | 3004 Gauge (mm) | 3004 Surface | Lamination Temperature (T2) | Thinwall Gauge (mm) | Thickwall Gauge (mm) | Delamination |
| 5 | 0.30 | C/P | 300° C. | 0.117 | 0.183 | 3 |
| 6 | 0.30 | As rolled | 320° C. | 0.117 | 0.183 | 5 |

Figure 10:
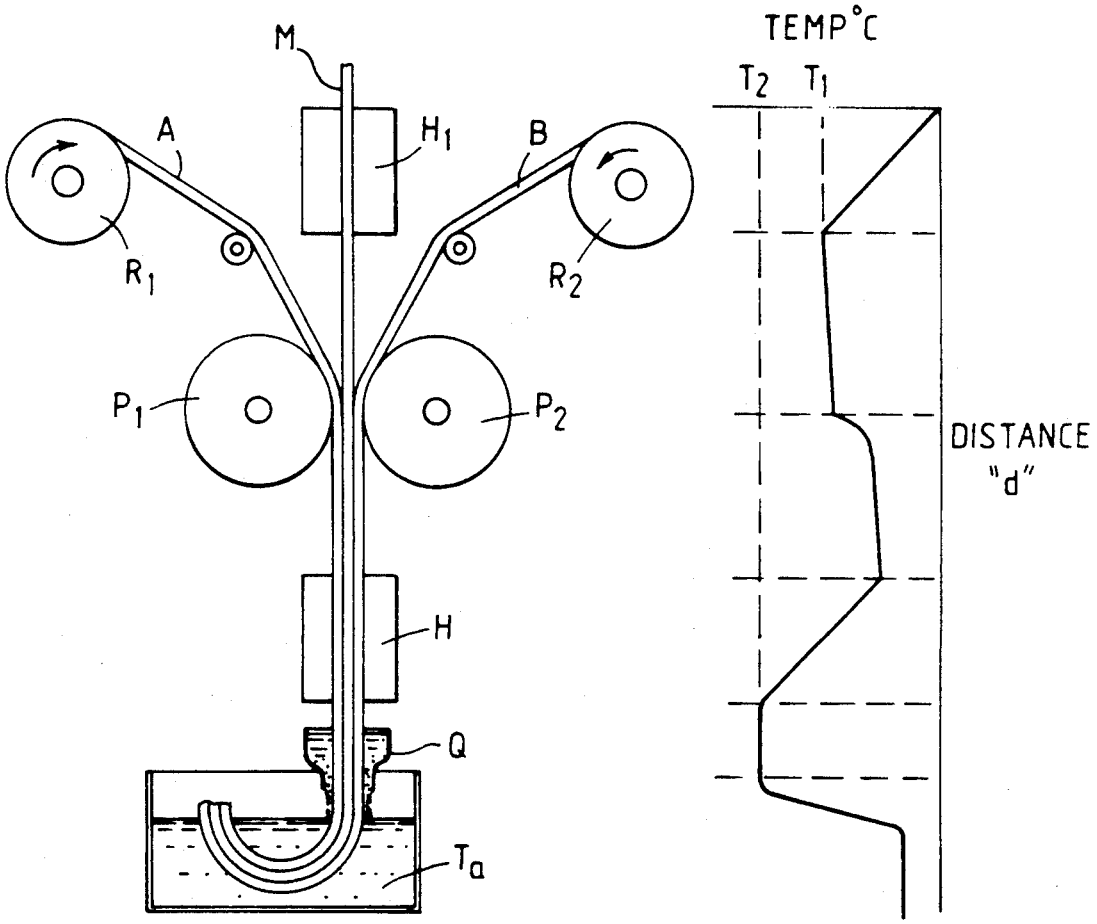
FIG. 10 is a diagrammatic sketch of apparatus with graph of temperatures arising in the laminate.

Notes
1. The thinwall/thickwall gauges are metal-only gauges
2. Film type - 12 micron coextruded copolyester/PET (copolyester to the metal) biaxially oriented
3. Surface - C/P is a commercial chromium phosphate finish
- As rolled indicates no after rolling chemical treatment before lamination
4. Temperature - See FIG. 10
5. Delamination - 0 to 5 0 = None 5 = Several mm delamination all around circumference

TABLE 2

| Polymer Coated DWI Cans - Delamination after Stoving | | | | | | | | |
|---|---|---|---|---|---|---|---|---|
| A | Aluminium alloy | | | | | | | |
| Example Number | 3004 Gauge (mm) | 3004 Surface | Lamination Temperature (T2) | Thinwall Gauge (mm) | Thickwall Gauge (mm) | Stove Temperature | Time | Delamination |
| 7 | 0.30 | C/P | 300° C. | 0.117 | 0.183 | 130° C. | 240s | 0 |
| 8 | 0.30 | As rolled | 300° C. | 0.117 | 0.183 | 130° C. | 240s | 0 |
| 9 | 0.30 | C/P | 300° C. | 0.117 | 0.183 | 180° C. | 15s | 0 |
| 10 | 0.30 | As rolled | 300° C. | 0.117 | 0.183 | 180° C. | 15s | 0 |

Note
1. Stove time is in seconds (See FIG. 3)
2. Delamination score as in Table 1.

What we claim is:

1. A method of forming a can body from a laminate of sheet metal and a polymeric film by:

(a) applying a lubricant to both surfaces of the laminate and cutting a blank from the laminate;

(b) drawing the blank to a cup having a bottom wall and a side wall upstanding from the periphery of the bottom wall;

(c) reducing the thickness of the side wall by pushing the cup through a wall ironing die, and (d) washing the can body, wherein, in step (a) the laminate is a laminate of sheet aluminium or aluminium alloy and a film of an amorphous linear polyester or copolyester;

and after step (c) but before step (d) a terminal margin only of the side wall of the wall ironed cup is heated to a temperature above 100° C. but below the crystalline melting point of the film.

2. A method according to claim 1 wherein the laminate has a polyester film applied to both major surfaces of the aluminium or aluminium alloy sheet.

3. A method according to claim 1 wherein the linear polyester is the product of reaction between a dibasic alcohol and a dibasic acid.

4. A method according to claim 1 wherein the polyester is the product of reaction between terephthalic acid and ethylene glycol.

5. A method according to claim 1 wherein the polyester is a copolyester which is the product of a reaction between an acid and an alcohol and a third component which is an acid or alcohol and which is present as less than 50% of the total acid or alcohol.

6. A method according to claim 1 wherein the surface of the aluminium or aluminium alloy has an anodised layer of oxide of thickness between 10 and 200 nanometers, between said aluminium or aluminium alloy, and said polyester.

7. A method according to claim 1 wherein the aluminium or aluminium alloy of the laminate has an anodised surface treatment that was carried out using phosphoric acid or sulphuric acid as the medium for anodising.

8. A method according to claim 1 wherein the aluminium alloy is alloy no. 3004.

9. A method according to claim 1 wherein the wall ironed cup is heated in an oven by hot air directed onto said side wall margin.

10. A method according to claim 9 wherein the cup is conveyed through the oven on a mesh belt.

11. A method according to claim 9 wherein the wall ironed cup is heated to a temperature greater than 150° C. but less than the crystalline melting point of the polyester for a period less than 20 seconds.

12. A method according to claim 1 wherein the side wall margin of the wall ironed cup is heated by energy from an induction coil adjacent said margin.

13. A method according to claim 12 wherein the side wall margin is heated to a temperature between 150° C. and the crystalline melting point of the polyester for a period of between 50 and 100 milliseconds.

14. A method according to claim 1 wherein the side wall margin of the wall ironed cup is heated by radiant energy.

* * * * *